United States Patent [19]

Chang

[11] Patent Number: 4,480,840

[45] Date of Patent: Nov. 6, 1984

[54] MULTI-SUIT CARD GAME

[76] Inventor: Yin-Jenn Chang, No. 29, Alley 16, Sun-Kuang Lane, Pei-Tuen District, Tai Chung City, Taiwan

[21] Appl. No.: 438,705

[22] Filed: Nov. 2, 1982

[51] Int. Cl.[3] ..... A63F 1/00

[52] U.S. Cl. ..... 273/292; 273/161; 273/304

[58] Field of Search ..... 273/292, 303, 304, 305, 273/306, 161

[56] References Cited

U.S. PATENT DOCUMENTS

| | | | |
|---|---|---|---|
| 1,738,902 | 12/1920 | Howard | 273/306 X |
| 3,072,408 | 1/1963 | Haak | 273/303 X |
| 4,147,363 | 4/1979 | Lee et al. | 273/304 |

*Primary Examiner*—Anton O. Oechsle

*Attorney, Agent, or Firm*—Cushman, Darby and Cushman

[57] ABSTRACT

A Chinese Poker deck which may be used for calculating the Chinese perpetual calendar and which may be composed into many new poker games. The Chinese Poker deck comprises 60 cards which are divided into two major kinds of cards, i.e., the celestial cards and the terrestrial cards. The celestial cards are divided into three suits (Sun, Moon, Star), and the terrestrial cards are also divided into three suits (Club, Bamboo, Pine). Each of the suits includes seven figure cards and three face cards. Further, among those Chinese Poker cards, 22 cards may be composed into two groups, i.e., one celestial stem group having ten cards, and one terrestrial branch group having twelve cards.

3 Claims, 10 Drawing Figures

| Classi-fication | Celestial Cards | | | Terrestrial Cards | | |
|---|---|---|---|---|---|---|
| Suit Cards | Sun | Moon | Star | Club | Bam-boo | Pine |
| Pattern | ○ | ☽ | ☆ | ❀ | ▭ | ♣ |
| Color | Red | Green | Black | Red | Green | Black |
| Figure Cards | | | | A | A | A |
| | | | | 2 | 2 | 2 |
| | 3 | 3 | 3 | 3 | 3 | 3 |
| | 4 | 4 | 4 | 4 | 4 | 4 |
| | 5 | 5 | 5 | 5 | 5 | 5 |
| | 6 | 6 | 6 | 6 | 6 | 6 |
| | 7 | 7 | 7 | 7 | 7 | 7 |
| | 8 | 8 | 8 | | | |
| | 9 | 9 | 9 | | | |
| Face Card | R | R | R | R | R | R |
| | 0 | 0 | 0 | 0 | 0 | 0 |
| | C | C | C | C | C | C |

| Classi-fication | Celestial Cards | | | Terrestrial Cards | | |
|---|---|---|---|---|---|---|
| Suit Cards | Sun | Moon | Star | Club | Bam-boo | Pine |
| Pattern | ○ | ☽ | ☆ | | | |
| Color | Red | Green | Black | Red | Green | Black |
| Figure Cards | | | | A | A | A |
| | | | | 2 | 2 | 2 |
| | 3 | 3 | 3 | 3 | 3 | 3 |
| | 4 | 4 | 4 | 4 | 4 | 4 |
| | 5 | 5 | 5 | 5 | 5 | 5 |
| | 6 | 6 | 6 | 6 | 6 | 6 |
| | 7 | 7 | 7 | 7 | 7 | 7 |
| | 8 | 8 | 8 | | | |
| | 9 | 9 | 9 | | | |
| Face Card | R | R | R | R | R | R |
| | 0 | 0 | 0 | 0 | 0 | 0 |
| | C | C | C | C | C | C |

Fig. 1

MULTI-SUIT CARD GAME

BACKGROUND OF THE INVENTION

The Chinese Poker deck comprises two kinds of cards, i.e. the celestial cards and the terrestrial cards. The celestial cards include three suits, i.e., the "sun", "moon", and the "star"; the terrestrial cards include three suits, i.e., the "club", "bamboo", and the "pine". The composition of these cards is based on the fortune-telling art, which involves the five primary elements (metal, wood, water, fire and sail), the ten celestial stems (Chia, I, Bing, Ding, Wu, Chi, Geng, Hsin, Ren, Guei), and the twelve terrestrial branches (Tze, Chou, Yin, Mao, Chen, Si, Wu, Wei, Shen, Yeou, Shuh, Hai). The Chinese Poker not only can be used for calculating the Chinese perpetual calendar to facilitate the study of the Chinese culture and the telling one's fortune, but also can be used for playing more games than the Western Poker.

SUMMARY OF THE INVENTION

The Chinese Poker comprises 60 cards, which are mainly divided into two categories, i.e., the celestial cards which have three suits, the "sun", "moon", and the "star", and the terrestrial cards that have three suits, the "club", "bamboo" and "pine". Each suit includes seven figure cards and three face cards.

Among these cards, ten of them are composed into a ten celestial stem cards, and twelve of them are composed into a twelve terrestrical cards so as to calculate the Chinese perpetual calendar for studying the Chinese culture; further, it can provide many card interesting games which not only include many basic games of the Western Poker, but also include some new games which are unable to be played with the Western Poker.

BRIEF DESCRIPTION OF THE DRAWINGS

FIG. 1 shows a composition of the Chinese Poker.

DETAILED DESCRIPTION

The Chinese Poker mainly comprised two kinds of cards, i.e. the celestial cards and the terrestrial cards, but the composition of suit is based on the theory of the "five primary elements" (metal, wood, water, fire, sail), and the ten celestial stems (Chia, I, Bing, Ding, Wu, Chi, Geng, Hsin, Ren, Guei, i.e. 甲，乙，丙，丁，戊，己，庚，辛，壬，癸), and the twelve terrestrial branches (Tze, Chou, Yin, Mao, Chen, Si, Wu, Wei, Shen, Yeou, Shuh, Hai, i.e., 子，丑，寅，卯，辰，巳，午，未，申，酉，戌，亥). In addition to being used for calculating the Chinese perpetual calender so as to study Chinese culture and apply to the fortune-telling practice, the Chinese Poker has provided some other interesting and informative games, which contains the basic games of the western poker and some games which cannot be played with the western poker.

According to the Chinese Poker, the composition of cards, the calculation of the perpetual calender, and the various games are described one by one as follows:

A. The composition of cards:

Referring to FIG. 1, there is shown a composition of the Chinese Poker, which comprises two kinds of cards, i.e., the celestial cards and the terrestrial cards. Said celestial cards include three suit cards, i.e., the sun suit, moon suit, and star suit. Said terrestrial cards include three suit cards, i.e., the club suit, bamboo suit, and the pine suit.

According to color, the cards are classified into three categories; the sun suit and the club suit cards are in red; the moon suit and the bamboo suit cards are in green; the star suit and the pine suit cards are in black. In brief, the Chinese poker cards may be classified into two major kinds (the celestial and the terrestrial), into three colors (red, green, and black), and six suits (sun, moon, star, club, bamboo, and pine). Each suit includes ten cards, and a total of 60 cards make the whole pack. In general, the sequence of honor card is that the celestial card is higher than the terrestrial, and in the suits, the sun suit is the highest card; then, it is followed by the moon suit, the star, club, bamboo, and pine (i.e., Sun>Moon>Star>Club>Bamboo>Pine). According to color, red is the highest, and then comes the green, and the black.

The celestial cards comprise three suits of cards, i.e., the sun, moon, and star suits, each of which includes ten cards (i.e., seven figure cards, 3 thru 9; and three face cards, "R, O, C"). There is a total of 30 cards in the celestial cards.

Figure 2:
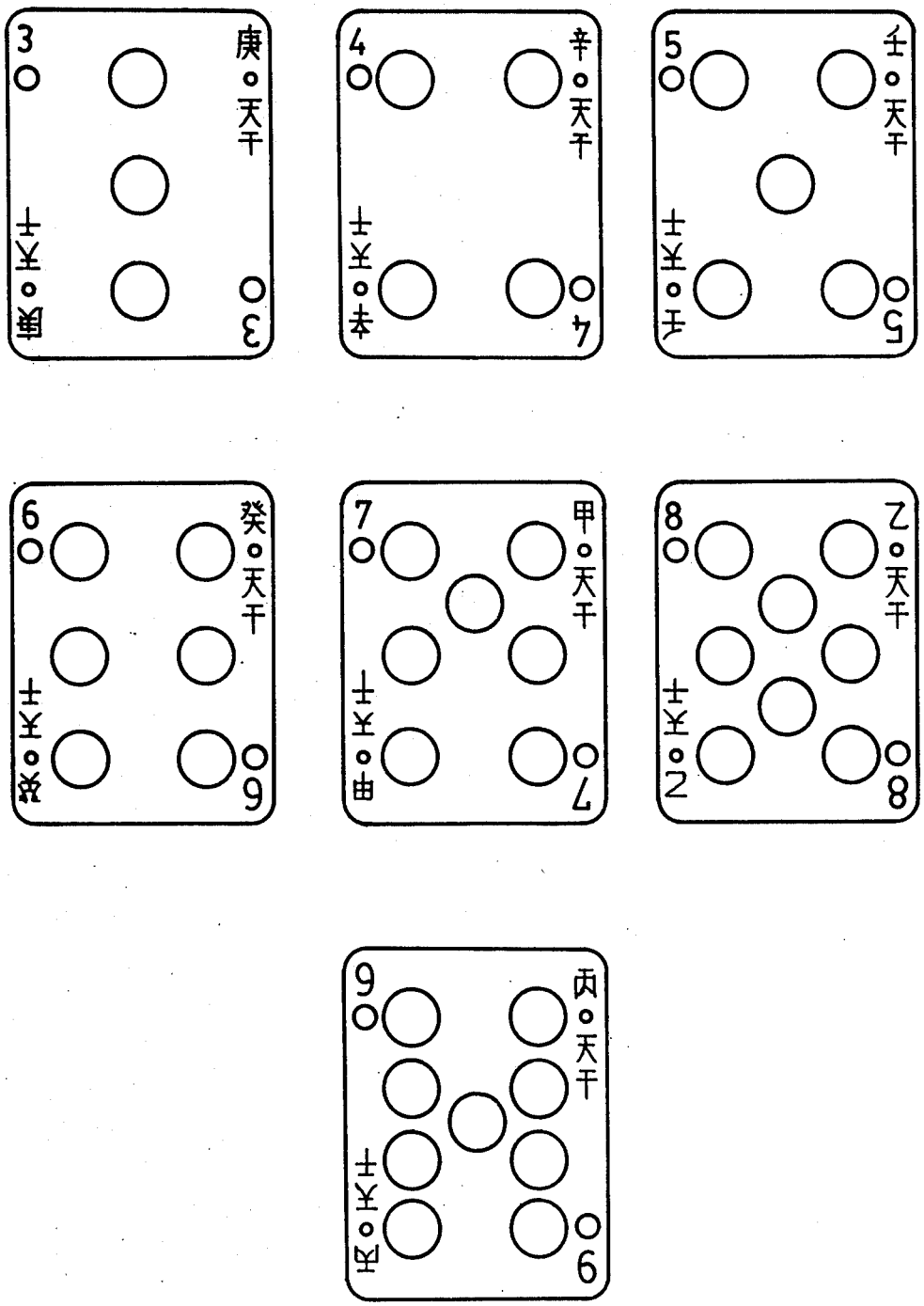
FIG. 2 shows the figure cards under the "Sun" suit in the celestial cards ( 天牌 ) of Chinese Poker.
Figure 3:
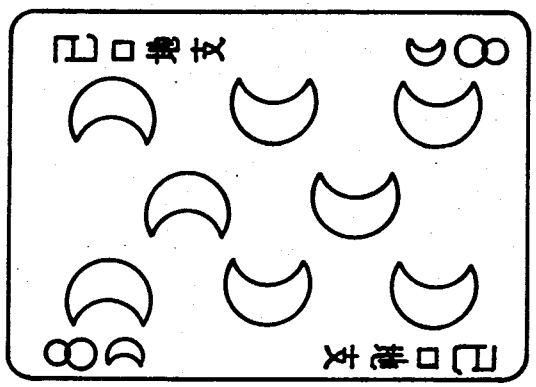
FIG. 3 shows a singleton "8 " of the figure cards under the "Moon" suit in the celestial cards ( 天牌 ) of Chinese Poker.

Referring to FIG. 2, there is shown the figure cards of sun suit in the celestial cards. Referring to FIG. 3, there is shown a singleton of the figure cards "8" of the moon suit.

Figure 4:
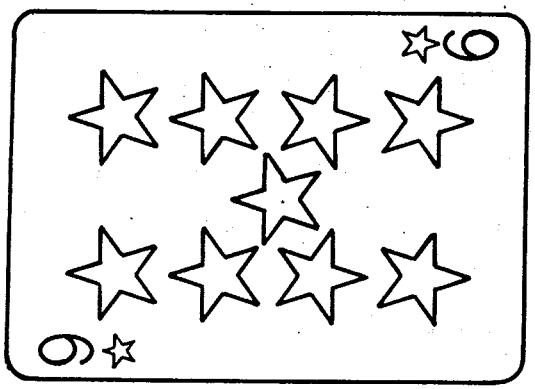
FIG. 4 shows a singleton "9" of the figure cards under the "Star" suit in the celestial cards ( 天牌 ) of Chinese Poker.

Referring to FIG. 4, there is shown a singleton of the figure cards "9" of the star suit.

Figure 5:
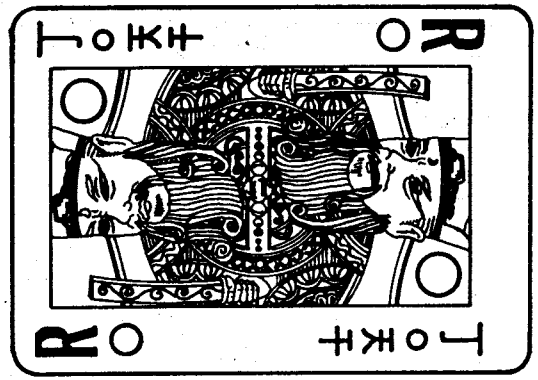
FIG. 5 shows the face cards under the "Sun" suit in said celestial cards.
Figure 5:
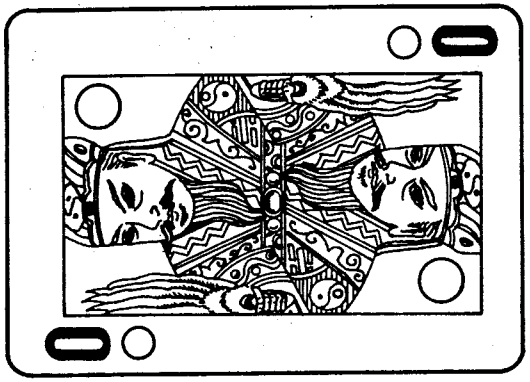
Figure 5:
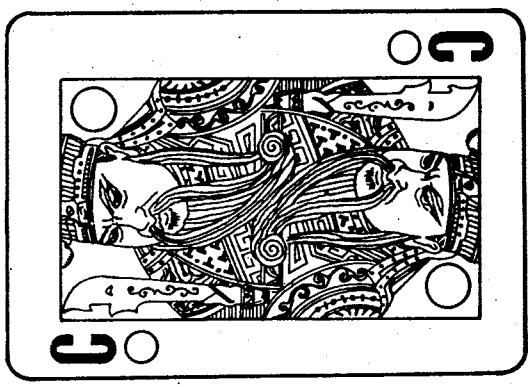

Referring to FIG. 5, there are shown the face cards of the sun suit in the celestial cards. In the face cards, every card having the same symbol (R, O, C) will have the same face pattern, but the card bearing the same symbol may further be identified with different suit patterns.

The terrestrial cards comprise also three suits of cards, i.e., the club, bamboo, and pine suit. Each of said suits includes ten cards; in other words, there are 30 cards in the terrestrial cards, and each suit includes seven figure cards (A, 2,3,4,5,6,7) and three face cards (R,O,C.).

Figure 6:
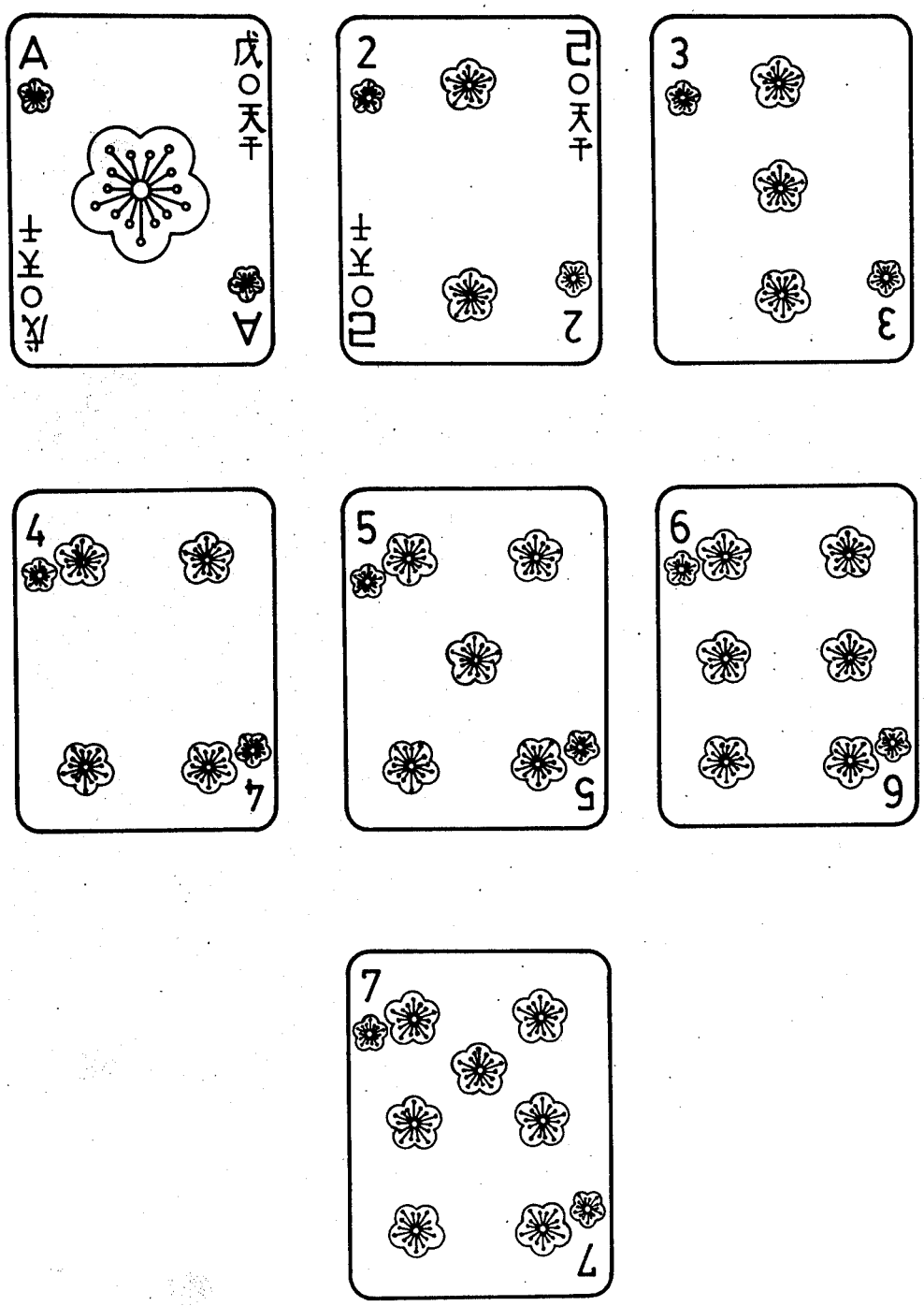
FIG. 6 shows the figure cards under the "Club" suit in the terrestrial cards ( 地牌 ) of Chinese Poker.

Referring to FIG. 6, there are shown all the figure cards of the club suit in the terrestrial cards.

Figure 7:
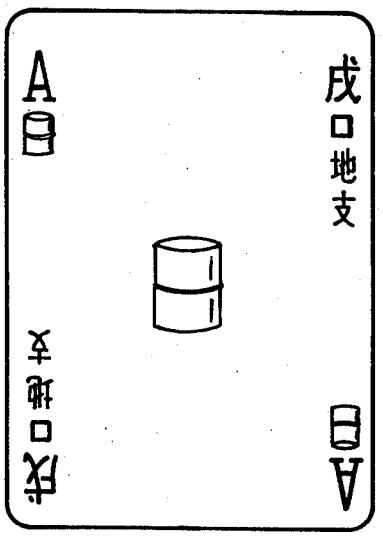
FIG. 7 shows a singleton "A" of the "Bamboo" suit in the terrestrial cards ( 地牌 ) of Chinese Poker.

Referring to FIG. 7, there is shown a singleton "A" of the figure cards of the bamboo suit in the terrestrial cards.

Figure 8:
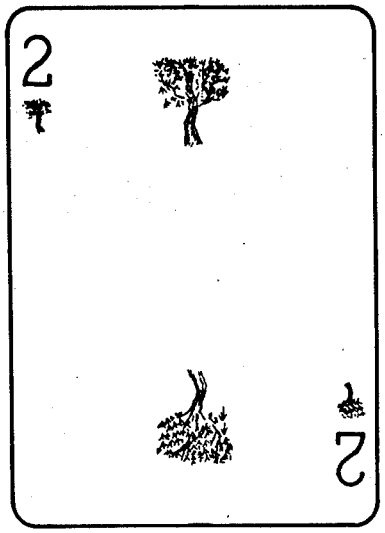
FIG. 8 shows a singleton "2" of the "Pine" suit in said terrestrial cards (地牌).

Referring to FIG. 8, there is shown a singleton "2" of the figure cards of the pine suit in the terrestrial cards.

Further, the symbol (R,O,C) and the face pattern of the face cards in the terrestrial cards are the same as those of the celestial cards; in other words, the face card symbols (R,O,C) and the face patterns in the six suits of the Chinese Poker are the same as that of the face cards of the sun suit in the celestial cards as shown in FIG. 5 except for the suit patterns (sun, moon, star, club, bamboo, and pine), which are six suits.

According to the ancient Chinese concept, the celestial (the sky) is above, and the terrestrial (the earth) is below; the five primary elements are existing between the celestial and the terrestrial. The God dwells in a heaven beyond the said three spaces. The sun, moon, and stars have long been named as in China the three lights, which are used for representing three suits in the celestial cards. The club, bamboo, and pine have long been considered, in China, as the three friends in the deep of winter, and therefore are used for representing the three suits in the terrestrial cards (since the club (or plum blossom) is the national flower of China, it is arranged at the first position in the three suits).

According to the ancient concept in China, the rays of the three lights can reach into the deep earth, and all creatures are raised under the sky; therefore "A" and "2" in Chinese Poker symbolize the earth, while "8" and "9" symbolize the sky (or celestial). Therefore, the figure cards in the celestial cards include "3,4,5, 6,7" and "8,9" as shown in FIG. 2. The figure cards in terrestrial cards include "A, 2" and "3,4,5,6,7" as shown in FIG. 6. The cards "3,4,5,6,7" in both the celestial and terrestrial cards symbolize the joint portion between the heaven and the earth. These five cards may be named as the five primary elements, in which "7" stands for metal, "6" stands for wood; "5" stands for water; "4" stands for fire, and "3" stands for sail. Said arrangement is designed for one who may be interested in fortune telling practice.

Referring to FIG. 5, there is shown a symbol "R" of the face cards to stand for "rightness"; therefore, the face pattern in the "R" card resembles the face of "Bau Kung" (包公), who is considered the God of rightness. The symbol "O" implies "Omnipotent"; therefore, the face pattern of "O" card resembles the face of "Kung Ming" (孔明) to symbolize the God of wisdom. The symbol "C" implies "Cast-iron" being represental with the face of "Guan Kung"(關公), who is deemed the God of righteousness and unbending. (It is said that "Bau Kung" is a title in honor of "Ban Chen" in Sung dynasty. "Kun Ming" is the alias of "Chu Gir Liang" in the Three Kingdom Period. "Guan Kung" is a title of honor of "Guan Yu" in the Three Kingdom Period. These three persons are the well-known historical personages in Chinese history, and are worshipped as Gods.)

In the Chinese's mind, the God is supposed to live in a heaven beyond or above the sky; therefore, the symbols (R,O,C) of the face cards are arranged over the figure cards of the celestial cards. In the general games, "R" stands for the figure "10", "O" stands for "11", and "C" stands for "12". In addition, "R.O.C" is the abbreviation of "Republic of China"; therefore, "R, O,C" being used as the symbols of the face cards may be able to stress the feature of Chinese Poker than using other symbols.

B. The Calculation of Perpetual Calendar:

The perpetual calendar was started to be used from the Yin-Shang dynasty about three thousand years ago. Since then, every dynasty in China would use it, which becomes a part of the Chinese heritage being handed down from generation to generation. The difference between the East and the West in counting the Chronological years is that the Chinese use the perpetual calendar, while the western countries use Gregorian calendar. For instance, in Chinese painting and scrolls, dictionaries, books, art pieces, and the tomb stone, the years were all marked with perpetual calendar system. Therefore, when studying Chinese history, appreciating Chinese curios, writings and paintings, and wanting to know one's standard birthday, one has to study the perpetual calendar. However, most of the modern Chinese people know little or nothing about it. In view of the facts, the inventor has developed a poker that is designed and composed in accordance with the theory of the ten celestial stems and the twelve terrestrial branches, and with the formulas designed by the inventors. Thru those formulas, the chronicle in perpetual calendar and in Western Calendar may be calculated and converted each other.

Figure 9:
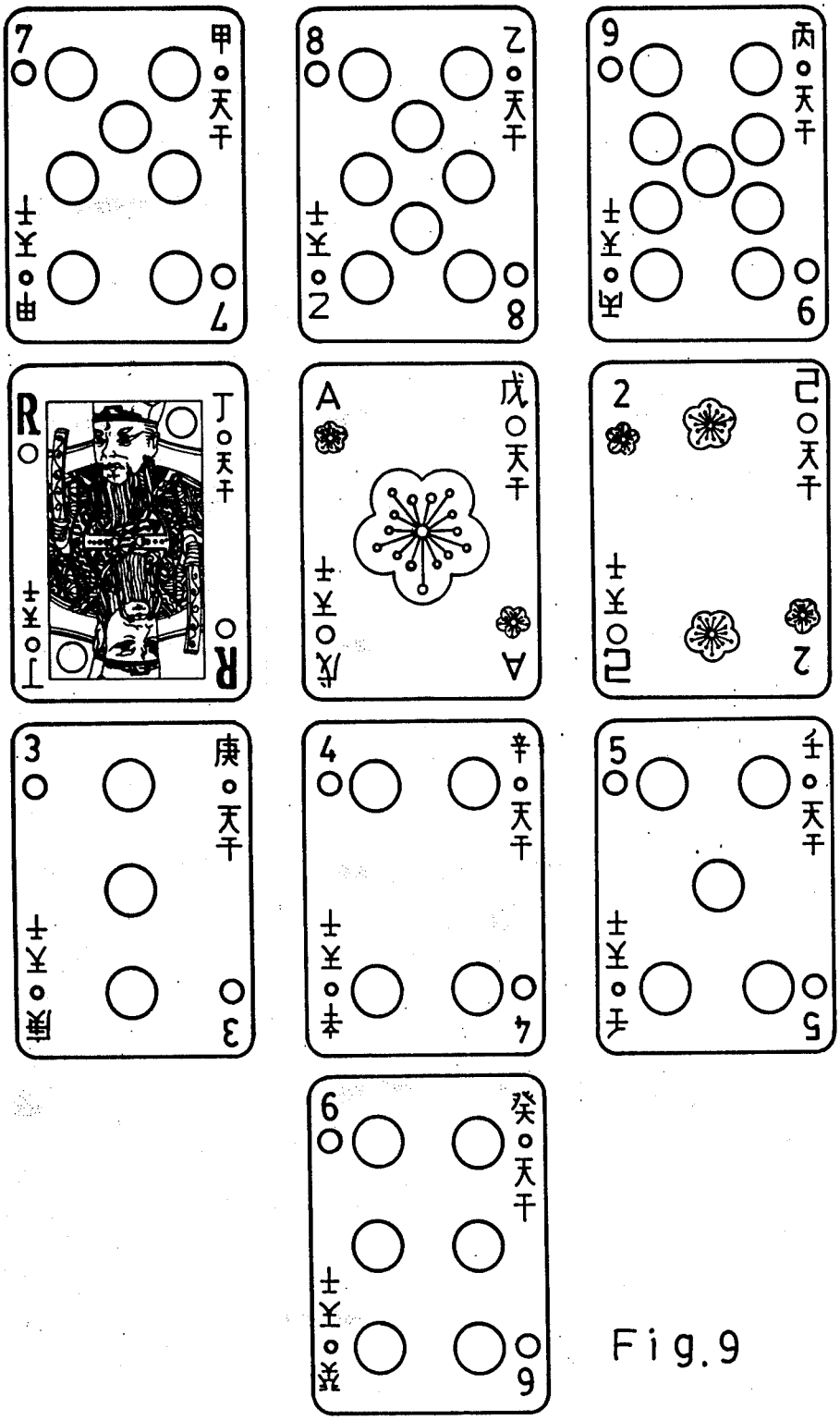
FIG. 9 shows the suit according to the ten celestial stem sequence.

The ten celestial stems (Chia, I, Bing, Ding, Wu, Chi, Geng, Hsin, Ren, Guei) are respresented respectively with seven figure cards of the celestial cards (3,4,5,6,7,8,9) and one face card "R", and two terrestrial cards (A,2). In each of said cards, a "天干" (celestial stem) and one of the stems are printed. The common figure cards (3,4,5,6,7) for both the celestial and terrestrial cards are designated as the five element cards. Use "7", the highest figure in said five element card, to represent the first stem of the ten celestial stems as shown in FIG. 9, in which an embodiment of the ten celestial stem suit is displayed; it includes eight cards of the sun suit of celestial cards and two cards of the club suit of terrestrial cards. The sequence of the ten celestial stems being printed in the cards shown in FIG. 9, an embodiment, is that "甲，乙，丙，丁，戊，己，庚，辛，壬，癸" are corresponding to "7,8,9, R,A,2,3,4,5,6" respectively.

Figure 10:
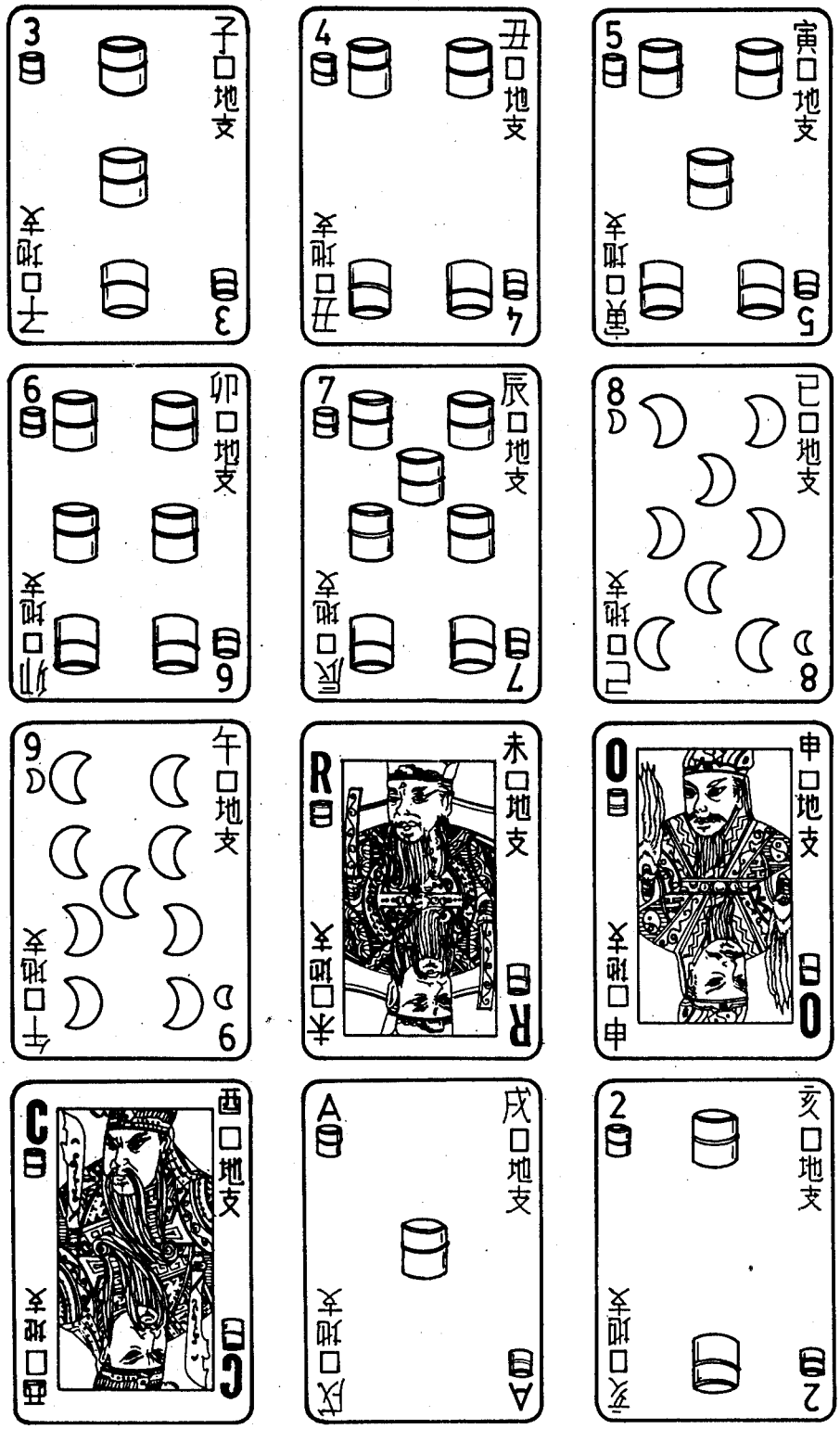
FIG. 10 shows the suit according to the twelve terrestrial branch sequence.

The twelve terrestrial branches (Tze, Chou, Yin, Mao, Chen, Si, Wu, Wei, Shen, Yeou, Shuh, Hai) are represented with seven different figure cards of the terrestrial cards, three face cards of different symbol, and two figure cards of the celestial cards, i.e. "A,2,3,4,5, 6,7,R,O,C,8,9"; since there are no figure cards "8 and 9" in the terrestrial cards, use two celestial cards instead. In the aforesaid 12 cards, each is printed with two Chinese characters "地支" and one of the 12 terrestrial branches. The said figure cards (3,4,5,6,7) are five element cards, among which the card having the lowest numeral is designated as the first character of the 12 terrestrial branches as shown in FIG. 10, which includes ten cards of the bamboo suit in the terrestrial cards and two cards of the moon suit in celestial cards. The sequence of the twelve terrestrial branches being printed in the cards shown in FIG. 10 is that "子，丑，寅，卯，辰，巳，午，未，申，酉，戌，亥" are corresponding to "3,4,5,6,7,8,9,R,O,C, A,2" respectively.

The chronicle of the perpetual calendar is started from "Chia Tze", "I Chou", "Bing Mao" and so on with the same sequence until "Guei Hai", Chinese cycle of sixty years; then, another Chinese cycle is started from "Chia Tze". For instance, the year 1984 is equal to "73" of the R.O.C. chronicle, which is a starting of another Chinese cycle (Chia Tze).

The present invention used R.O.C. chronicle "73" (1984) as a reference year to calculate the perpetual calendar either tracing the years passed or calculating the years to come.

In calculating the years, first, display the ten celestial stems (shown in FIG. 9) and the twelve terrestrial branches (shown in FIG. 10), and then calculate it with the formulas as follows:

a. To calculate the years prior to AD 1984 or 73 of R.O.C.:

(1). Codes to be used:

M—A year of Gregorian calendar to convert into the equivalent year in perpetual calendar.

N—A year of R. O. C. to convert into the equivalent year in perpetual calendar.

X—The difference between "M" year and 1984 of Gregorian calendar.

Y—The difference between "N" year and 73 of R. O. C.

Z—The first digit of "X" or "Y".

V—The quotient X (or Y)÷12

W—The remainder of X (or Y)÷12

A—The valve of the celestial stem in "M" or "N" year.

B—The valve of the terrestrial branch in "M" or "N" year.

(2). The calculation method of the celestial stem:

Formula 1.: $1984 - M = X$ (or $73 - N = Y$)
If $Z \geqq 7$; $17 - Z = A$.
If $Z < 7$; $17 - Z = A$.

(3). The calculation method of the terrestrial branch:

Formula 2.: $X \div 12 = V$ and remainder W
or $Y \div 12 = V$ and remainder W)
If $W \geqq 3$; $15 - W = B$
If $W < 3$; $15 - W = B$ After finding the value of "A" with the formula 1, check the ten celestial stem cards (shown in FIG. 9) so as to find out one of the ten celestial stems (Chia, I, Bing, Ding, Wu, Chi, Geng, Hsin, Ren, Guei) from "A" number of cards. (note; In the face cards, R=10; O=11; C=12).

After finding the value of "B" with formula 2, check the twelve terrestrial branch cards shown in FIG. 10 (Tze, Chou, Yin, Mao, Chen, Si, Wu, Wei, Shen, Yeou, Shuh, Hai) so as to find out one of the twelve terrestrial branches from "B" number of cards; then, match the celestial stem with the terrestrial branch in regular sequence to form the same "M" or "N" year of stem/-branch system.

(4). Explanation with an embodiment:

Find out the year in Chinese perpetual calendar that is equivalent to 1953 to Gregorian calendar. With formula 1.: M=1953, 1984−1953=X=31 Since "Z" is the first digit of "X", "Z"=1 Since "Z"<7, the value of "A" may be obtained with the formula, 7−Z=A, i.e., A=7−1=6. Now use formula 2.: 31÷12=2 and remainder 7. Since W=7, and W>3, the value of "B" may be obtained with formula 15−W=B, i.e., 15−7=8. Now, in the ten celestial stems (Shown in FIG. 9), find out A=6, the figure card "6", which bears a celestial stem of "Guei, 癸 ". Since B=8, find out it in the twelve terrestrial branches (shown in FIG. 10). It shows that the figure card "8" bears a terrestrial branch of "Si, 巳 "; then, it is found that 1953 is equal to the "Guei Si" year in Chinese perpetual calendar.

b. To calculate the years after 1984 or 73 of R.O.C.:

(1). The calculation method of the celestial stem:

(The codes to be used are the same as mentioned in A (1) above)

Formula 3.: $M - 1984 = X$ (or $N - 73 = Y$)
If $Z > 3$; $Z - 3 = A$
If $Z \leqq 3$; $Z + 7 = A$ (2). The calculation method of the terrestrial branch:

Formula 4.: $X \div 12 = V$, and remainder W.
(or $Y \div 12 = V$ and remainder W)
If $W > 9$; then, $W - 9 = B$
If $W \leqq 9$; then, $W + 3 = B$ (3). Explanation with an embodiment:

Find out the year in Chinese perpetual calendar that is equivalent to 2010 of Gregorian calendar. With formula 3.: M=2010, 2010−1984=X=26; Since "Z" is the first digit of "X", Z=6. Since Z>3, the value of "A" may be obtained with formula, Z−3=A, i.e. A=3. Now, use formula 4.: X÷12=V and remainder W; then, 26÷12=2 and remainder 2. Since W=2, and W<9, B=W+3=5. (formula 4. in (2) above) Now, from the ten celestial stem cards and the twelve terrestrial branch cards, find out respectively the figure card "3" and "5", which represent respectively the stem "Geng, 庚 " and the terrestrial branch "Yin, 寅"; therefore, the stem/branch year of "Geng Yin" is equal to the year 2010 in Gregorian calendar.

c. To calculate the year of Gregorian calendar with a stem/branch year:

(1). Codes to be used:

M—Converting a stem/branch year of the perpetual calendar into the year of Gregorian calendar.

N—Converting a stem/branch year of the perpetual calendar into the year of R. O. C. system.

X—The difference between "M" and 1984.

Y—The difference between "N" and the year 73 of R. O. C. system.

N—A natural number.

PQ—An integer less than 60.

P—The second digit in PQ.

Q—The first digit in PQ.

A—The value of the celestial stem year known.

B—The value of the terrestrial year known.

W—The remainder of X (or Y)÷12.

(2). Formulas:

Formula 5.:
If $A > 7$, $17 - A = Q$
If $A \leqq 7$, $7 - A = Q$
Formula 6.:
If $B > 3$, $15 - B = W$.
If $B \leqq 3$, $3 - B = W$.
Formula 7.:
If $Q \geqq W$, $(Q - W) \div 2 = P$
If $Q < W$, $(12 + Q - W) \div 2 = P$
Formula 8.:
$X = N \cdot 60 + PQ$ (or $Y = N \cdot 60 + PQ$)
$M = 1984 - X$ (or $N = 73 - Y$)

(3). Explanation with embodiment:

Find out the "Chia Wu" (甲午) war with Japan in Ching dynasty happened how many years ago and in which year of the Gregorian calendar. First, find out the "甲" (Chia) from the ten celestial stem cards (shown in FIG. 9), and then find the value of "A", i.e. "7". Further, find out the "午" (Wu) from the twelve terrestrial branch cards (shown in FIG. 10), and then find the value of "B", i.e. "9". According to formula 5, $7-A=Q$, if $A=7$, the $Q=0$. According to formula 6., $15-B=W$, If $B>3$, $W=15-9=6$. According to formula 7. $(12+Q-W)\div 2=P$, if $Q<W$, $P=(12+Q-6)\div 2=3$, and $Q=0$; consequently, $PQ=30$. According to formula 8., $X=N\cdot 60+PQ$, since the "Chia Wu War" happened about 100 years ago, $N=1$; therefore, $X=1\cdot 60+30=90$. Since $1984-M=X$, and $M=1894$, $X=90$, which is the difference between 1984 and the year of "Chia Wu". Therefore, said "Chia Wu" happened 88 years ago according to 1982, i.e, 1894.

C. The various games of Chinese Poker:

In the playing cards and the chess, their compositions have a similar nature, i.e., one pack of cards or a set of chess comprises a given number of suits of digital card or character cards. For instance, the Western Poker includes (1-13)×4; in Chinese chess, it includes (marshal to pawns)×2. The Chinese Poker is irregular in composition. It comprises (the figure cards, 1-7+the face cards, R,O,C)×3 and (the figure cards, 3-9,+the face cards, R,O,C)×3, of which the way of composition is unprecedented.

For instance, the six person and three team bridge tournament, and the two-card dragon-connecting games in Chinese Poker are impossible to play with the Western Poker. In the Western Poker, there is only one single composition i.e., 13 cards×4. With the present invention, two discrete packs of cards may be formed in addition to the 60 card pack. The first pack may include 36 cards (30 celestial cards and the six terrestrial cards, "A,2"). With three colors, it forms 12 cards×3 suits, which may be used for playing the games of dragon-connecting, picking-up points, and bridge.

The second pack includes 48 cards (i.e. from the 60 cards, pull out "8,9" of the celestial cards and the "A,2" of the terrestrial cards).

The general games and the games with the present invention are described one by one as follows: (when playing the games with Chinese Poker, there will be nothing to do with the ten celestial and the twelve terrestrial cards.)

a. Picking-up Points:

It is similar to the "Picking up red points" in the Western Poker. In Chinese Poker, there are three kinds of games to play the "Picking-up points"; they are picking-up the "celestial, the terrestrial, and the red points"; all of the games use 60 cards.

(1). The way of dealing cards:

It is a slightly different from that of the "picking-up red points" in the Western Poker. In most of the games, except for playing by four persons, after shuffling the cards, the last player will not touch the cards (i.e., the last player knows nothing about the bottom card). After dealing the cards, it need not to put four open cards on the table (i.e., every player can see the cards of other players).

The dealing methods when playing by more persons are listed as follows:

| | persons | | | | |
|---|---|---|---|---|---|
| items | 2 | 3 | 4 | 5 | 6 |
| Number of cards to be dealt to each person | 15 | 10 | 7 | 6 | 5 |
| Number of open cards | 0 | 0 | 4 | 0 | 0 |
| Re-shuffle by last player | NO | NO | YES | NO | NO |

Note:
In playing the game of "picking-up red points" with the Western Poker, there are four open cards, and the last player may re-shuffle the cards.

(2). The way of playing:

It is similar to the "picking-up red points" in the Western Poker. The banker leads one card first, and then picks up one card from the stock cards and open it. The next player will do the same until all the stock cards being opened. In the event of a card discarded or picked up from the stock able to form a total number of "10" together with one of open cards of a player, or a face card able to be matched with an open face card on the table, the player may take said two cards for counting the points.

(3). Point Count:

1. Picking-up the celestial points:

It is to pick up all the figure cards of the celestial cards of the three suits. The points of cards "3" thru "8" are to be counted with the digit on their face, while the figure card "9" and the three face cards of each suit are counted as ten points respectively; in addition, the card "A" in the club suit is counted as 21 points.

It makes a total of 240 points, which may be divided by the number of players to find the basic points for each player should have. For instance, if there are two players, each of them should have 120 points; for three players, each of them should have 80 points; for four players, each of them should have 60 points; for five players, each of them should have 48 points; for six players, each of them should have 40 points.

(2). Picking-up the terrestrial points: It is to pick up all the figure cards of the terrestrial cards of the three suits. The points of cards "2" thru "7" are to be counted with the digit on their face; the "A" card in "Club" suit is counted as "7" points, while figure cards "A" of the rest suits, such as "Bamboo and Club" will be counted as one point; each of the face cards will be counted as ten points; therefore, there is a total of 180 points, which may be divided with number of players to obtain the basic points for each player.

(3). Picking-up the red points: It is to pick up the red cards in the two suits of "sun" and "club"; for the figure cards, all will be counted with the digit on their face except that the "A" card of "Club" suit is counted as 14 points, and the figure cards "9" in "sun" suit is counted as 10 points. Further, each of the figure cards is to be counted as 10 points. It makes a total of 144 points, and it is good for two to four persons to play; the basic points for each player will be 72, 48, and 36 respectively.

b. Dragon Connecting:

It is similar to the "Dragon Connecting" game of the Western Poker (or the colloquially named "7-arranging" game), but the "Dragon connecting" in Chinese Poker has three ways to play, i.e. (1) up-to-sky and down-to-earth; (2) two-card dragon-connecting; (3) "6" connecting. All said games will use 60 cards.

(1). Up-to-sky and down-to-earth:

1. The rules of connecting: All the three color cards are divided into three rows, which includes two suits of red (Sun and Club), two suits of green (Moon and Bamboo), and two suits of black (Star and Pine). All of said rows used the figure card "5" as the reference card, from which the dragon-connecting may either go up or down. Since each row of cards includes a celestial suit and a terrestrial suit, it is necessary to have the two same figure cards of both the celestial and the terrestrial figure cards "3,4,5,6,7" appeared on the table before the next sequence card to continue the connecting. The going-up connecting of the cards in suits "Sun, Moon, Star" is by following the sequence of "5,6,7,8, 9, R,O,C," and going-down connecting is by following the sequence of "5,4,3". The connecting of the cards in suits "Club, Bamboo, Pine" may be going up by following the sequence of "5,6,7" and going down by following the sequence of "5,4,3,2,A, R,O,C".

2. The rules of playing:

First, deal all the cards evenly to the players, the player who gets the figure card "5" in "Sun" suit will lead that "5"; then, the next player should follow the aforesaid sequence to connect, and the connecting may be done with the three rows simultaneously. Now, each player should discard one card at a time; if he (or she) cannot follow the connecting sequence, the player just says "pass" and need not to cover one card. The game will be ended whenever a player has discarded all the cards in hand.

3. Point count:

The player who can discard all the cards is deemed as the top winner with the point counted as zero. The rest players may be judged with the cards left in hands, i.e. the points of the figure cards will be counted with their facial figure, and the points of the face cards will be counted as ten points each; the player who get the highest points is the bigger loser.

(2). The dragon-connecting game with two cards:

1. The rules of connecting:

The cards are arranged into three rows with the colors of red, green and black. The figure card "6" may be used as the reference card, from which the dragon connecting may be connected upwards or downwards. The suit cards "Sun, Moon, and Star" may be connected upwards by following the sequence of "6,7,8,9, R,O,C,", and may be connected downwards by following the sequence of "6,5,4,3,". The suit cards "Club, Bamboo, and Pine" may be connected upwards by following the sequence of "6,7,8,9, R,O,C "; since there are no figure cards "8,9" in the terrestrial cards, the face cards of "R,O,C" connecting may be continued upon the figure cards of the celestial cards appearing. The suit cards "Club, Bamboo, and Pine" may be connected downwards by following the sequence of "6,5,4,3, 2,A"; further, in the dragon-connecting game with two cards, there is no such a requirement that the two suits of cards in one row, such as the figure cards "3,4,5,6,7" and the face cards "R,O" must appear with two cards simultaneously before making the next connecting; in other words, the connecting may be continued either upwards or downwards with one or two of the figure cards (3,4,5,6,7) and the face cards (R,O) appearing.

2. The rules of playing:

The 60 cards are first dealt evenly to the players; the player who has the figure card "6" of "Sun suit" will lead the card; then, the next player may lead with one or two cards; when leading with two cards, the two cards must be in ordinal number sequence and in the same color (for instance, the figure card "6" in "Bamboo suit"; the figure card "5" in "Moon suit"), or two cards in same color and having the same figure or same face pattern (for instance, the face card "R" in "Club suit" and the face card "R" in "Sun suit"). In the event of failure to follow the connecting, the player may discard a waste card with its face being up, and put it in his front. (The waste card means that any one card in the figure cards "7,6,5,4,3 " and the face cards "R,O" in one row is left, and it can never be used for connecting in the game).

In case of a player having neither a card to make the regular connecting nor a waste card, the player may discard any one card that he (or she) wants with its face being up and by putting it in his (or her) front. The game will be going on in such a connecting way until one of the players having no card to lead or discard, and the game is ended.

3. Point count:

The points of one player may be obtained by calculating the facial figure of the figure cards and the face card which has ten points each left in front of the player. The player who gets the highest points is considered the biggest loser.

(3). 6-connecting:

1. The rules of connecting:

Divide the cards into six rows with the six suits (Sun, Moon, Star, Club, Bamboo and Pine), and use the figure card "6" as the reference card to connect either upwards or downwards. In the suits of "Sun, Moon and Star", the upwards connecting is following the sequence from "6,7,8,9,R,O, to C", while the downwards connecting is following the sequence from "6,5,4, to 3".

In the suits of "Club, Bamboo and Pine", the upwards connecting is following the sequence from "6,7,R,O, to C", while the downwards connecting is following the sequence from "6,5,4,3,2A".

(2). The rules of playing and the point count:

It is the same as those of "7-connecting" in the Western Poker except for the way of connecting.

c. Bridge:

It uses 60 cards, and may have three playing ways, i.e., (1) honey-moon bridge, (2) the four person in two team bridge, and (3) the six person in three team bridge, which are further described as follows:

(1). Honey-moon bridge:

It is similar to the honey-moon bridge of the Western Poker except that:

1. Each player will be dealt with 15 cards in Chinese Poker; in the Western Poker, each player will be dealt with 13 cards.

2. The bid sequence in Western Poker is following the sequence of "Spade>Heart>Diamond>Club"; the bid sequence in Chinese Poker is following the sequence of suits, i.e., "Sun>Moon>Star>Club>Bamboo>-Pine".

3. In the Western Poker, the basic tricks are six tricks; upon bidding "one", the player must win seven tricks, and upon bidding "two", the player must win eight tricks and so on. In Chinese Poker, the basic tricks are seven tricks; upon bidding "one", the player must win eight tricks. Upon bidding "two", the player must win nine tricks, etc.

4. The major-minor sequence for the celestial cards in Chinese Poker is that

C>O>R>9>8>7>6>5>4>3, and for the terrestrial cards that A>C>O>R>7>6>5>4>3>2.

(2) . Two-pair player bridge:

The rules of playing is similar to that of the Western Poker except for the four different points mentioned in the (1) the honey-moon bridge.

(3). Three-pair player bridge:

It needs six players to be divided into three teams for tournament. It is an interesting game good for wit matching in a family or a group of friends. The playing rules are similar to those of the two-pair player bridge except for the following differences:

1. Ten cards will be dealt to each player.

2. The basic tricks are three; upon bidding "one", the team must win four tricks, and upon bidding "two", the team must win five tricks, etc.

3. In playing the three-pair player bridge, the trump card team will fight against the rest two teams which are the joint defenders. The way of point counting for the two defender teams is that when the two teams winning the game, the total points winned by the two teams should be scored under the team that gets more tricks while the other team that gets less tricks will be deemed as tie. In case of failure, the total points lost by the two teams should be scored under the team that gets less tricks, while the other team will be deaemed as tie. Moreover, the two defender teams mau evenly divide the points winned or lost.

d. Thirteen points and thirty-one points games:

Since the composition of the Chinese Poker is different from that of the Western Poker, the ten-and-half point and the twenty-one point games in the Western Poker have been converted into the "13 points" and "31 points" games in Chinese Poker. Their playing rules are described respectively as follows:

(1). "13 points" game:

If the total points are thirteen (13), or a player has six cards without exceeding thirteen points, said player will be credited with double points. Each face card may be scored as 0.5 point. The methods of dealing and pulling cards are the same as the "10.5 points" game in Western Poker.

(2). "31 points" game:

Each player is dealt with three cards before pulling card (in Western Poker, each player being dealt with two cards). Each face card is equal to ten points; the figure card "A" is equal to one or eleven (11) points. If the total points are 31 points or a player has six cards without exceeding 31 points, said player will be credited with double points.

e. Show-hand:

There are three ways in playing show-hand game, and the rules thereof are described as follows:

(1). The five-card show-hand:

1. Number of cards:

It needs a total of 27 cards, which comprise six figure cards "8,9" in the celestial cards, and three figure cards "A" in the terrestrial cards, and all the face cards (18 cards). In the face cards, "R" is equal to "10"; "O" is equal to "11"; "C" is equal to "12"; the figure card "A" may be equal to "7" or "13".

2. The rules of playing is the same as that of the 28-card-show-hand in the Western Poker. Each player will be deal with five cards at the most.

3. The major and minor sequence:

Flush straight>five identical cards (five cards having the same face symbol)>flush>straight>four clubs>-full house>treble-ton>two pairs>a pair.

(2). The six-card show-hand:

1. Number of cards:

It needs 48 cards, which comprise the common figure cards "3,4,5,6,7" (a total of 30 cards) in both the celestial and the terrestrial cards, and all the face cards (18 cards). In the face cards, "R" is equal to "8"; "O" is equal to "9"; "C" is equal to "10" or "2".

2. The rules of playing:

Each player is dealt with two (or one) closed cards and one opened card; then, the tournament is started. Each player may obtain six cards at the most. The rest rules are the same as those of the show-hand in Western Poker.

3. The major and minor sequence:

Six identical cards (having same figure or symbol) >flush straight>five identical cards>flush>-straight>four clubs and one pair>two trebletons>four clubs>three pairs>trebleton and one pair>trebleton>two pairs>a pair.

(3). Luo-Sung:

1. Number of cards:

It needs 60 cards; and the major and minor sequence according to the card face is "C>O>R>9>8>7>6>5>4>3>2>A", but "A" may counted as "13" or "1".

2. The rules of playing:

Each player is dealt with 15 cards (same as the Luo-Sung game in the Western Poker), which are divided into three groups; three cards form the first group, and then every six cards form two groups being put behind the first group by following the minor to major sequence; then, open the groups for show-down.

3. The major and minor sequence:

Six identical cards>flush straight>five identical cards>flush>straight>four clubs and a pair>two trebletons>four clubs>three pairs.

f. Chess Poker:

There are two playing ways in Chess Poker, i.e., (1) tiger hunting and (2) the three kingdoms. The cards to be used in those games are 48 cards respectively, which comprise all the figure cards from "3" to "7" (30 cards), and all the face cards (18 cards).

(1). Tiger hunting:

1. The composition and the major-minor sequence:

It is composed of 2–6 cards, and is different from the six card show-hand. It may only compose of the following seven groups, i.e., six identical cards, five identical cards, four clubs, trebleton, a pair, six-card straight, and six-card flush. It can not be composed of a group of "four clubs and a pair" and "two trebletons". In case of having more than one trebleton or more than one pair appearing, the major-minor sequence will be determined by the suit card sequence, i.e., Sun>Moon>Star>Club>Bamboo>Pine.

2. The Playing rules:

It is similar to the "tiger hunting" in chess game. A total of 48 cards may be dealt to the players evenly, or each player may be dealt with eight cards first; then let the banker bid. The banker may optionally bid 1–6 cards. The rest players may lead the card in accordance with the number of cards bidden by the banker. The card to be led will be determined by the rest players, but the number of cards to be led should be the same as that of being bidden by the banker. The card led should all be covered (not shown) until all the rest players leading the cards and then being opened by the banker in right sequence. If a player find his (or her) card to be led being lower than the card that has been opened by the banker, he (or she) may have the card remained in covert condition. In show down, the winner will be the new banker; then, the aforesaid lead procedures will be repeated again until the cards is hand being led completely.

3. Point count:

There are two methods, i.e., first, the basic tricks method, in which the total tricks are divided by the number of players to obtain the number of basic tricks. The player who obtains tricks more than the basic tricks will win that number of tricks. The player who obtains tricks lower than the basic tricks will lose that number of tricks. The total number of tricks is equal to the cards dealt to each player; for example, if there are four players who each are dealt with 12 cards, the total tricks should be 12. During playing, the number of cards to be dealt by a player will be the number of tricks the winner will get. Secondly, the player who last deals and wins will be winner of that game. (i.e., the player who deals all his cards)

(2). The three kingdoms:

1. The composition and the major-minor sequence: The major difference between the three kingdoms and the tiger hunting is to lead the cards, in which the player of the three kingdom should compose and lead the card or cards out of the 1–6 cards having the same color for comparing them in major-minor sequence. In play "the three kingdom", there are no trebleton, the four clubs, the five identical cards, and the six identical cards, but there only are the two pairs, straight, a pair, and singleton; the straight must be a series of three cards in the same color. The rule for major-minor sequence for the singleton is the same as that of the tiger hunting.

2. The playing rules:

The cards are to be dealt to the players evenly, or every player is dealt with eight cards. The method to lead the card is the same as that of the tiger hunting game, i.e., a player may lead one to six cards at a time. After the banker bidding, the rest players will lead their cards in right order with the card face opened (overt card); the rest players must lead the same card as the banker did (i.e. red, green, and black, which are named as three kingdoms). The player who leads the highest card will win; then, the winner will be the banker, and will bid and lead again and so on until the cards being led completely. The winner will be the player who leads last and wins last.

g. Monopoly:

(1). Flush monopoly:

1. The number of cards to be used:

It needs a total of 60 cards, which are good for three to six players.

2. The playing rules:

After the cards being evenly dealt to the players, the banker will lead the first card to have its face opened and being placed in front of the banker; then, the next player will also lead a card in same suit as the banker did, and picks up the card led by the banker and put it in his (or her) front position; then, the next player may lead the card and so on until one player unable to follow with the same suit, and then the last player who could follow the suit will possess of the whole stack of cards, which will be put in his front. Further, another round will be started by a player (the next player who could not follow) to lead with a card whatever he (or she) has and so on. Upon all the players having no card in hand, the game is ended.

3. Point count:

Every player may count the cards in the stack in his front. The basic cards for each players is equal to the 60 cards being divided with the number of players. A player who has got more than the basic cards will obtain the equal number of points; A player who has got less than the basic cards will lose the equal number of points. In counting a stack of cards winned, if a player get ten cards of the same suit, said ten cards may be deemed as a monopoly suit. Whenever a player gets a monopoly suit, the rest players each should give three cards to the player who has got the monopoly suit.

(2). Monopoly of same points:

1. The number of cards to be used:

It needs 48 cards, which comprise all the figure cards from "3" to "7" (30 cards) and all the face cards (18 cards).

2. The playing rules:

They are similar to those of monopoly flush except that the same suit of cards must be led in monopoly flush game, while the same figure or same symbol (the face cards) cards should be led in the game of "monopoly of same points".

3. Point count:

In counting the cards in front of a player, the player who gets six cards in identical figure or symbol will be deemed as obtaining "monopoly of said same points"; then, the rest players should give the winner (the monopoly winner) a card. After wards, the player may count his points with his total cards in comparison with the basic cards.

I claim:

1. A multi-suit card game, comprising:

a total of sixty cards divided into three color groups, with twenty cards in each color group, wherein within each color group, then cards are designated as "Celestial cards" with the designations respectively "3,4,5,6,7,8,9,R,O,C", and the remaining ten cards within each color group are designated as "Terrestrial cards" with the respective designations "A,2,3,4,5,6,7,R,O,C", wherein said Celestial cards represents respectively the sun, moon and stars by the respective color groups, and said Terrestrial cards represent respectively clubs, bamboo, and pine by the respective color groups.

2. A multi-suit card game, comprising:

a total of sixty cards divided into three color groups, with twenty cards in each color group, wherein within each color group, ten cards are designated as "Celestial cards" with the designations respectively "3,4,5,6,7,8,9,R,O,C", and the remaining ten cards within each color group are designated as "Terrestrial cards" with the respective designtions "A,2,3,4,5,6,7,R,O,C", wherein said Celestial cards represent respectively the sun, moon and stars by the respective color groups, and said Terrestrial cards represent respectively clubs, bamboo, and pine by the respective color groups, wherein a sequence of "7,8,9,R,A,2,3,4,5,6" composes a group of Celestial stem cards representative of ten respective Celestial stems, namely Chia, I, Bing, Ding, Wu, Chi, Geng, Hsin, Ren, and Guei.

3. A multi-suit card game, comprising:

a total of sixty cards divided into three color groups, with twenty cards in each color group, wherein within each color group, ten cards are designated as "Celestial cards" with the designations respectively "3,4,5,6,7,8,9,R,O,C", and the remaining ten cards within each color group are designated as "Terrestrial cards" with the designations respectively "A,2,3,4,5,6,7,R,O,C", wherein said Celestial cards represent respectively the sun, moon and stars by the respective color groups, and said Terrestrial cards represent respectively clubs, bamboo, and pine in their respective color groups, wherein, a sequence of "3,4,5,6,7,8,9,R,O,C,A,2" commposes a group of Terrestrial branch cards representative respectively of twelve Terrestrial branches, namely Tze, Chou, Yin, Mao, Chen, Si, Wu, Wei, Shen, Yeou, Shuh and Hai.

* * * * *